United States Patent [19]

Shuttleworth et al.

[11] Patent Number: 5,011,811

[45] Date of Patent: Apr. 30, 1991

[54] IN SITU DYE GENERATION FOR THERMAL TRANSFER PRINTING

[75] Inventors: Leslie Shuttleworth, Webster, N.Y.; Michael J. McManus, Peabody, Mass.

[73] Assignee: Eastman Kodak Company, Rochester, N.Y.

[21] Appl. No.: 490,116

[22] Filed: Mar. 7, 1990

[51] Int. Cl.[5] ..... B41M 5/035; B41M 5/18; B41M 5/22; B41M 5/26

[52] U.S. Cl. ..... 503/201; 8/471; 428/195; 428/913; 428/914; 503/216; 503/217; 503/218; 503/223; 503/226; 503/227

[58] Field of Search ..... 8/471; 428/195, 913, 428/914; 503/201, 216–218, 223, 226, 227

[56] References Cited

U.S. PATENT DOCUMENTS

| | | | |
|---|---|---|---|
| Re. 28,956 | 9/1976 | Wainer | 96/48 HD |
| 3,013,013 | 12/1961 | Carboni | 260/240 |
| 3,332,557 | 5/1967 | Schwab | 117/36.2 |
| 3,936,307 | 2/1976 | Asakawa et al. | 96/90 R |
| 4,388,362 | 6/1983 | Iwata et al. | 428/211 |
| 4,390,616 | 6/1983 | Sato et al. | 430/338 |
| 4,500,896 | 2/1985 | Kubo et al. | 503/204 |
| 4,622,565 | 11/1986 | Watanabe et al. | 503/201 |
| 4,703,335 | 10/1987 | Matsushita et al. | 503/204 |
| 4,740,494 | 4/1988 | Watanabe et al. | 503/201 |
| 4,745,046 | 5/1988 | Borror et al. | 430/332 |
| 4,824,822 | 4/1989 | Yamamoto et al. | 503/201 |

FOREIGN PATENT DOCUMENTS

| | | | |
|---|---|---|---|
| 0170492 | 2/1986 | European Pat. Off. | 503/201 |
| 3602437 | 7/1986 | Fed. Rep. of Germany | 503/201 |
| 60-156760 | 8/1985 | Japan | 8/636 |
| 60-158262 | 8/1985 | Japan | 8/636 |
| 62-220557 | 9/1987 | Japan | 8/636 |
| 63-015857 | 1/1988 | Japan | 8/636 |

*Primary Examiner*—Bruce H. Hess
*Attorney, Agent, or Firm*—Andrew J. Anderson

[57] ABSTRACT

In situ dye generation in a thermal transfer system is achieved by reacting an electrophile with a coupler compound to form an arylidene dye. The electrophile and/or the coupler compound are transferred from a donor element to a receiver element where they react to form a colored dye. The invention comprises a dye image recording element comprising a support bearing the electrophile which has the structure:

wherein

X is halogen, substituted or unsubstituted alkylsulfonyloxy, substituted or unsubstituted arylsulfonyloxy, or substituted or unsubstituted acyloxy;

$E^1$, $E^2$, $E^3$, and $E^4$ are each independently hydrogen, substituted or unsubstituted alkyl or alkenyl having up to about six carbon atoms, substituted or unsubstituted aryl having up to about ten carbon atoms, halogen, cyano, benzoxazolyl, nitro, $—CO_2R$, —COR, $—CONH_2$, —CONHR, —CONRR, or $—SO_2R$, wherein each R is independently substituted or unsubstituted alkyl or alkenyl having up to about six carbon atoms, or substituted or unsubstituted aryl having up to about ten carbon atoms, with the proviso that at least two of the E groups are other than hydrogen, alkyl, alkenyl, aryl or halogen;

$B^1$ and $R^2$ represent the atoms necessary to complete optional five- or six-member rings formed with carbonyl moieties of $E^1$, $E^2$ or $E^3$;

$B^3$ represents hydrogen or the atoms necessary to complete an optional five- or six-member ring with a carbonyl moiety of $E^1$;

and n is zero or one.

28 Claims, No Drawings

IN SITU DYE GENERATION FOR THERMAL TRANSFER PRINTING

This invention relates to receiving and donor elements used in thermal transfer printing, and more particularly to the use of reactive compounds (electrophiles and couplers) for in situ dye generation in a thermal transfer system.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271 by Brownstein entitled "Apparatus and Method For Controlling A Thermal Printer Apparatus," issued Nov. 4, 1986, the disclosure of which is hereby incorporated by reference.

The thermal transfer systems described above routinely use the imagewise transfer of a preformed dye from a dye-donor element to a dye-receiving element. One of the problems in selecting dyes for such systems is obtaining good transfer efficiency to produce high maximum density. Preformed dye molecules of high molecular weight require large amounts of energy for sufficient transfers.

U.S. Pat. No. 4,824,822 of Yamamoto et al discloses a thermosensitive recording method comprising subliming or evaporating a compound A and/or a compound B onto a recording sheet and then reacting compounds A and B together on the recording sheet in order to form coloring matter in situ on the recording sheet. Examples of compound B are aromatic amines, and examples of compound A are materials forming free radicals. These compounds react together upon exposure to light to form coloring matter. While this system may require less energy to transfer compounds A and/or B compared to transfer of a preformed dye, the chemistry used requires the additional time, expense and inconvenience of a light exposure step.

In situ generation of a color image in a recording element by reaction of a leuco dye and a developer is also well known as may be seen from the following U.S. Pat. Nos. 4,740,494, 4,703,335, 4,622,565, 4,500,896, 4,390,616, 4,388,362, as well as many others.

Leuco dyes, however, generally have nearly the same molecular weight as the resulting colored dye. Therefore, no energy savings is achieved by transferring a leuco dye compared to a preformed dye. Also, leuco dyes are generally capable of forming only a single dye hue, thus limiting their use in forming multi-color images.

It would be desirable to provide a thermal dye transfer system having minimum energy requirements, which would also allow for the formation of multi-color images, and also require a minimum number of steps.

These and other objects are achieved in accordance with the invention, which comprises a dye image recording element comprising a support bearing an electrophile capable of reacting with a coupler compound to form an arylidene dye, the electrophile having the following structure:

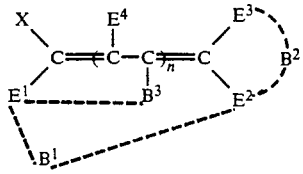

wherein

X is halogen, substituted or unsubstituted alkylsulfonyloxy, substituted or unsubstituted arylsulfonyloxy, or substituted or unsubstituted acyloxy;

$E^1$, $E^2$, $E^3$, and $E^4$ are each independently hydrogen, substituted or unsubstituted alkyl or alkenyl having up to about six carbon atoms, substituted or unsubstituted aryl having up to about ten carbon atoms, halogen, cyano, benzoxazolyl, nitro, $—CO_2R$, —COR, $—CONH_2$, —CONHR, —CONRR, or $—SO_2R$, wherein each R is independently substituted or unsubstituted alkyl or alkenyl having up to about six carbon atoms, or substituted or unsubstituted aryl having up to about ten carbon atoms, with the proviso that at least two of the E groups are other than hydrogen, alkyl, alkenyl, aryl or halogen;

$B^1$ and $B^2$ represent the atoms necessary to complete optional five- or six-member rings formed with carbonyl moieties of $E^1$, $E^2$ or $E^3$;

$B^3$ represents hydrogen or the atoms necessary to complete an optional five- or six-member ring with a carbonyl moiety of $E^1$; and n is zero or one.

The X substituent of such compounds is chosen to be reactive with an active hydrogen atom of a preselected coupler compound and to split-off the electrophile when it and the coupler are reacted together. The remaining portion of the electrophile combines with the coupler compound at its active hydrogen position to form a resulting arylidene dye.

The dye image recording elements of the invention comprising the above-defined electrophiles may take the form of a donor element or a receiver element.

In the process according to the invention, electrophiles in a donor element may be imagewise transferred to a receiving element containing coupler compounds by imagewise heating the donor element, and reacted together with the coupler compounds to form a dye image. Alternatively, coupler compounds may be imagewise transferred from a donor element to a receiving element containing electrophiles. The electrophiles are sufficiently reactive with the couplers described below such that an additional light exposure step is not required after bringing the electrophile and coupler together to react to form a dye. Further, a single coupler may be reacted with different electrophiles to form dyes of different hues. Alternatively, a single electrophile may be reacted with different couplers to form dyes of different hues.

A further embodiment of the invention comprises a dye image recording assemblage comprising a first element comprising a support bearing a preselected coupler compound, and a second element comprising a support bearing an electrophile as defined above. The first and second elements of the assemblage may be either a receiving element and a donor element, respectively, or a donor element and a receiving element.

In an alternative embodiment of the invention, both the electrophiles and coupler compounds may be present in separate adjacent areas of a donor element. A dye image may then be formed by sequentially transferring the electrophiles and coupler compounds from the donor element to a receiving element where they are reacted together to form a dye image. At least one of the electrophile and the coupler compound is transferred imagewise, while the other may be transferred either imagewise or non-imagewise (uniformly).

By transferring both the electrophiles and coupler compounds from a donor element to a receiver element, the advantage of lower power requirement due to transfer of smaller molecules is retained while the need for a special receiver element containing an electrophile or coupler compound is eliminated. Also, where both the electrophiles and coupler compounds are transferred imagewise, there is the additional advantage of eliminating the presence of large amounts of residual unreacted electrophile or coupler compound in low density areas of the image. Where a single coupler compound is transferred to react with multiple individually imagewise transferred electrophiles to form an image with multiple hues, the density data for all the individually transferred electrophiles can be added to obtain the required density data for the coupler compound to be transferred imagewise. Similarly, a single electrophile may be transferred imagewise corresponding to the total density data for multiple individually imagewise transferred coupler compounds.

In a preferred embodiment of the invention, the electrophile has one of the following structures:

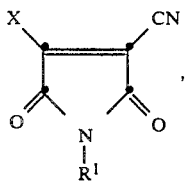

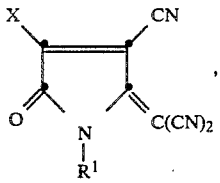

, or

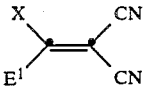

where $R^1$ is hydrogen, or substituted or unsubstituted alkyl or alkenyl having up to about six carbon atoms, or aryl having up to about 10 carbon atoms. Specific examples of these electrophiles include:

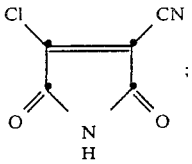

(EL-1)

which may be prepared as described in Wiley, R. and Slaymaker, JACS, 80, 1385–8 (1958);

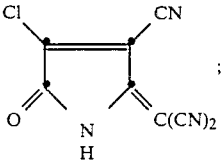

(EL-2)

which may be prepared as described in U.S. Pat. No. 3,013,013; and

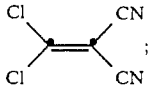

(EL-3)

which may be prepared as described in Josey, A., et al, J. Org. Chem. 32, 1941 (1967).

Other representative electrophiles suitable for use in the dye image recording element of the invention include:

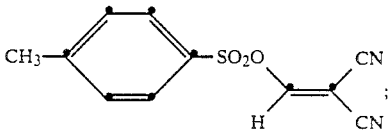

(EL-4)

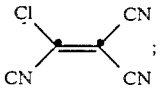

(EL-5)

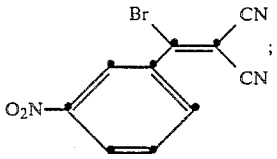

(EL-6)

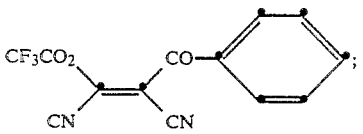

(EL-7)

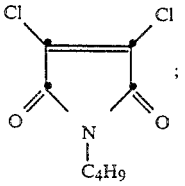

(EL-8)

-continued

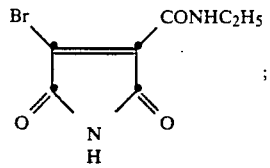

(EL-9)

;

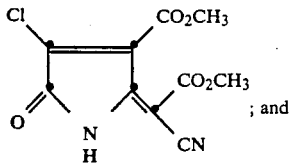

(EL-10)

; and

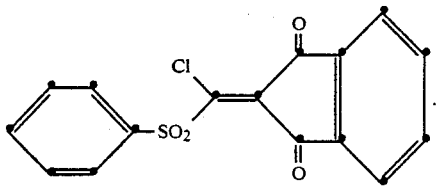

(EL-11)

As set forth above, the preselected coupler compounds for use in the invention are materials with an active hydrogen atom that will react with the electrophiles described above to form an arylidene dye. Examples of classes of such compounds include aromatic amines, aromatic hydroxyl compounds, compounds comprising a five-member unsaturated hetero-ring having at least one N, O, or S atom, and compounds of the formula $G^1—CH_2—G^2$ wherein $G^1$ and $G^2$ are each independently cyano, substituted or unsubstituted aryl, five—or six-member N, O, or S containing unsaturated hetero-rings, $—CO_2R^2$, $—COR^2$, or $—CONR^2R^3$, wherein $G^1$ and $G^2$ may together optionally form a carbocyclic ring, and where $R^2$ and $R^3$ are each independently hydrogen or substituted or unsubstituted alkyl, alkenyl, or aryl having up to about ten carbon atoms.

The possible variations for the coupler compound structures are diverse, and examples of the aromatic amines and hydroxyl compounds include substituted or unsubstituted derivatives or monomer units of:

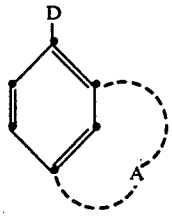

where D is —OH or $—NR^2R^3$, where $R^2$ and $R^3$ are as defined above, and A represents the members necessary to complete an optional five- or six-member carbocyclic or heterocyclic ring; and

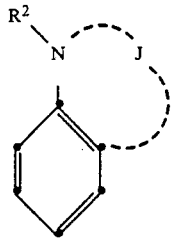

where $R^2$ is as defined above, and J represents the members necessary to complete a five- or six-member heterocyclic ring. Examples of compounds comprising a five-member unsaturated hetero-ring include substituted or unsubstituted derivatives or monomer units of:

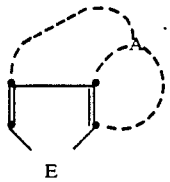

where E is —S—, —O—, or $$—\overset{|}{N}R^2,$$

and where $R^2$ and A are as defined above.

Specific representative coupler compounds suitable for use in the invention are listed below, wherein (H*) is used to indicate the position on the coupler compound of the active hydrogen that will react with the electrophiles described above to form an arylidene dye:

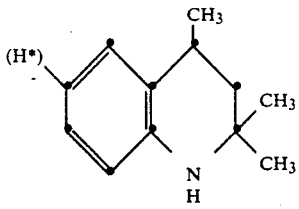

(C-1)

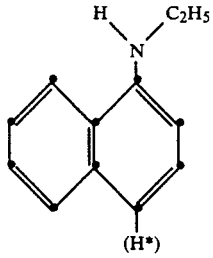

(C-2)

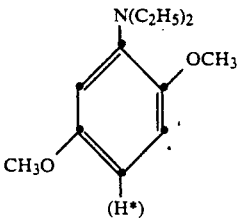

(C-3)

-continued
(C-4)
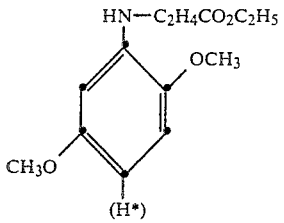
(C-5)
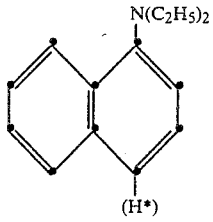
(C-6)
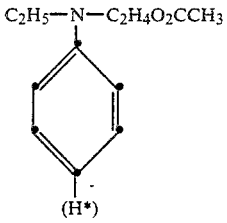
(C-7)
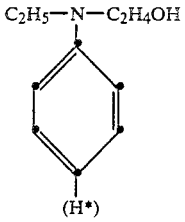
(C-8)
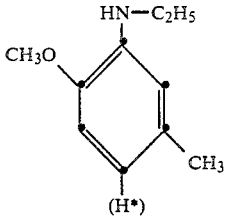
(C-9)
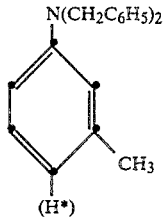
(C-10)
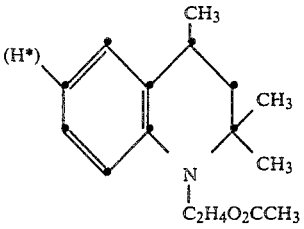
-continued
(C-11)
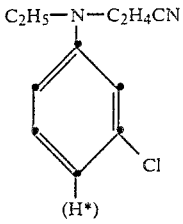
(C-12)
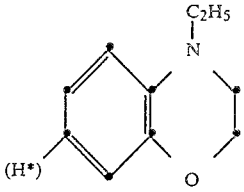
(C-13)
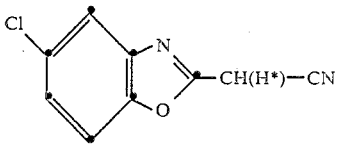
(C-14)
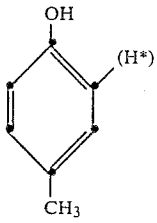
(C-15)
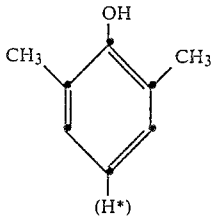
(C-16)
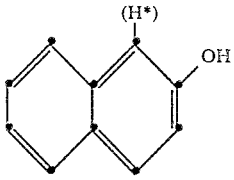
(C-17)
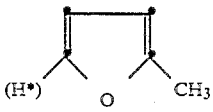
(C-18)
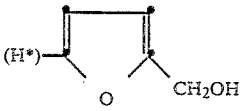
(C-19)
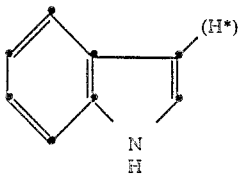

-continued (C-20)

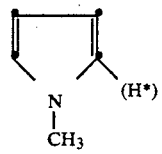

(C-21)

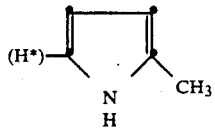

(C-22)

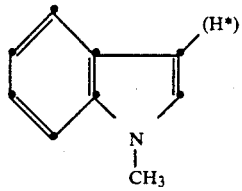

(C-23)

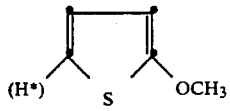

(C-24)

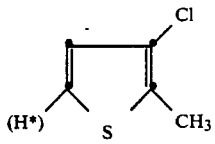

(C-25)

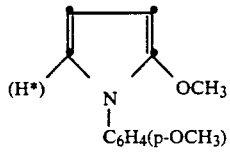

(C-26) $C_6H_5CO—CH(H^*)—CO—NHC_4H_9$ (C-27) $C_2H_5O_2C—CH(H^*)—CO_2C_2H_5$ (C-28)

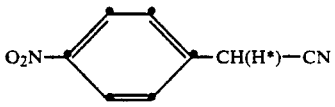

(C-29)

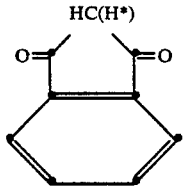

(C-30)

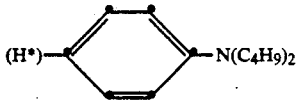

Donor elements of the invention comprise a support bearing an electrophile or coupler compound, or both an electrophile and coupler compound in separate adjacent areas. Preferably, the electrophile and/or coupler compound is dispersed in a polymeric binder layer on the donor element support. The donor polymeric binder may be, for example, a cellulose derivative, e.g., cellulose acetate hydrogen phthalate, cellulose acetate, cellulose acetate propionate, cellulose acetate butyrate, cellulose triacetate, cellulose tripropionate; a polycarbonate; poly(styrene-co-acrylonitrile), a poly(sulfone) or a poly(phenylene oxide). The binder may be used at a coverage of from about 0.1 to about 5 g/m$^2$.

Any material can be used as the support for the donor element provided it is dimensionally stable and can withstand the heat of the thermal printing heads. Such materials include polyesters such as poly(ethylene terephthalate); polyamides; polycarbonates; glassine paper; condenser paper; cellulose esters such as cellulose acetate; fluorine polymers such as polyvinylidene fluoride or poly(tetrafluoroethylene-co-hexafluoropropylene); polyethers such as polyoxymethylene; polyacetals; polyolefins such as polystyrene, polyethylene, polypropylene or methylpentane polymers; and polyimides such as polyimide-amides and polyether-imides. The support generally has a thickness of from about 2 to about 30 $\mu$m. It may also be coated with a subbing layer, if desired.

A barrier layer comprising a hydrophilic polymer may also be employed in the donor element between its support and the electrophile or coupler layer which provides improved transfer densities. Such barrier layer materials include those described and claimed in U.S. Pat. No. 4,700,208 of Vanier et al, issued Oct. 13, 1987.

The reverse side of the donor element may be coated with a slipping layer to prevent the printing head from sticking to the donor element. Such a slipping layer would comprise a lubricating material such as a surface active agent, a liquid lubricant, a solid lubricant or mixtures thereof, with or without a polymeric binder. Preferred lubricating materials include oils or semi-crystalline organic solids that melt below 100° C. such as poly(vinyl stearate), beeswax, perfluorinated alkyl ester polyethers, phosphoric acid esters, silicone oils, poly(caprolactone), carbowax or poly(ethylene glycols). Suitable polymeric binders for the slipping layer include poly(vinyl alcohol-co-butyral), poly(vinyl alcohol-co-acetal), poly(styrene), poly(styrene-co-acrylonitrile), poly(vinyl acetate), cellulose acetate butyrate, cellulose acetate or ethyl cellulose.

The amount of the lubricating material to be used in the slipping layer depends largely on the type of lubricating material, but is generally in the range of about 0.001 to about 2 g/m$^2$. If a polymeric binder is employed, the lubricating material is present in the range of 0.1 to 50 weight %, preferably 0.5 to 40, of the polymeric binder employed.

Receiving elements of the invention comprise a support bearing an electrophile or coupler compound. Preferably, the electrophile or coupler compound is dispersed in a polymeric binder layer on the receiving element support. Such a receiving element binder layer also functions as a receiving layer for the electrophile or coupler compound transferred from the donor element. Where both the electrophile and coupler compound are to be transferred from a donor element, a conventional thermal dye transfer receiving element comprising a support having thereon a receiving layer may be used. The receiving element binder and receiving layer may comprise, for example, a polycarbonate, a polyurethane, a polyester, polyvinyl chloride, poly(styrene-co-acrylonitrile), poly(caprolactone) or mixtures thereof, and may be present in any amount which is effective for the intended purpose. In general, good results have been obtained at a concentration of from about 1 to about 5 g/m$^2$.

The receiving element support may be a transparent film such as a poly(ether sulfone), a polyimide, a cellulose ester such as cellulose acetate, a poly(vinyl alcohol-co-acetal) or a poly(ethylene terephthalate). The support for the receiving element may also be reflective such as baryta-coated paper, white polyester (polyester with white pigment incorporated therein), an ivory paper, a condenser paper or a synthetic paper such as du Pont Tyvek ®.

The electrophiles and coupler compounds may be employed in the donor and receiving elements at any concentration which is effective for the intended purpose. To provide a Status A image density of above 1.0, the electrophiles are employed at 0.01 to 1.0 g/m$^2$ in the donor or the receiver element, and the coupler compounds are employed at 0.03 to 3.0 g/m$^2$ in the donor or the receiver element.

The donor element employed in certain embodiments of the invention may be used in sheet form or in a continuous roll or ribbon. If a continuous roll or ribbon is employed, it may have only one electrophile and/or coupler compound thereon or may have alternating areas of different electrophiles and/or coupler compounds chosen to generate dyes of different hues such as cyan, magenta, yellow, black, etc., to enable full color prints to be produced.

Thermal printing heads which can be used to transfer electrophiles or coupler compounds from the donor elements employed in the invention are available commercially. There can be employed, for example, a Fujitsu Thermal Head (FTP-040 MCS001), a TDK Thermal Head F415 HH7-1089 or a Rohm Thermal Head KE 2008-F3. Alternatively, other energy sources may be used to transfer the electrophiles or coupler compounds such as laser or ultrasound.

The following examples are provided to illustrate the invention.

EXAMPLE 1

This example illustrates thermal dye-generation imaging with the electrophile in the donor and the coupler in the receiver.

Donor elements were prepared by coating on a first side of a 6 μm polyethylene terephthalate support:

(1) a subbing layer of a titanium alkoxide (duPont Tyzor TBT ®) (0.12 g/m$^2$) coated from a n-propyl acetate and 1-butanol solvent mixture, and (2) a layer of the indicated electrophile (EL-1, EL-2, or EL-3, illustrated above) (0.22 g/m$^2$) in a cellulose acetate propionate binder (2.5% acetyl, 45% propionyl) (0.32 g/m$^2$) coated from ethyl acetate.

On the reverse side of the donor supports was coated:

(1) a subbing layer of a titanium alkoxide (duPont Tyzor TBT ®) (0.12 g/m$^2$) coated from a n-propyl acetate and 1-butanol solvent mixture, and (2) a slipping layer of Emralon 329 ® (Acheson Colloids Corp.) dry film lubricant of poly(tetrafluoroethylene) particles in a cellulose nitrate resin binder (0.54 g/m$^2$) coated from propylacetate, toluene, 2-propanol, and 1-butanol solvent mixtures.

A receiving element, R-1, was prepared by coating on a white-reflective support of titanium dioxide pigmented polyethylene terephthalate a subbing layer of poly(acrylonitrile-co-vinylidene chloride-co-acrylic acid) (79:14:7 wt ratio) (0.07 g/m$^2$) from a butanone and cyclopentanone solvent mixture. This support with subbing layer was subjected to electrostatic discharge treatment, and a layer of the indicated coupler (0.23 g/m$^2$) in a binder of a polycarbonate resin derived from bisphenol A and 1,5-pentanediol (50:50 wt ratio of diol and dihydric phenol) (2.9 g/m$^2$) was then coated from methylene chloride.

A second receiver, R-2, was made as above but used a polyester derived from terephthalic acid, ethylene glycol, and 1,4-bis(β-hydroxyethoxy)benzene (2:1:1 wt ratio) (2.9 g/m$^2$) in place of the polycarbonate binder.

A donor element strip approximately 3 cm × 15 cm in area was placed in contact with the coupler-binder layer side of a receiving element of the same area. This assemblage was clamped to a motor driven 14 mm diameter rubber roller. A TDK Thermal Head L-133 (No. 6-2R16-1) was pressed with a force of 3.6 kg against the donor element side of the contacted pair pushing it against the rubber roller.

The imaging electronics were activated causing the donor/receiver assemblage to be drawn between the printing head and roller at 3.1 mm/sec. Coincidentally the resistive elements in the thermal print head were pulsed for discrete sequential intervals at per-pixel pulse widths from 0 up to 8 msec to generate a stepped density image. The voltage supplied to the print-head was approximately 21 volts representing approximately 1.4 watts/dot (12. mjoules/dot) for maximum power.

The receiver element was separated from the donor element and the Status A blue, green and red reflection densities of each single color generated image consisting of a series of eight graduated density steps one cm square were read after 1 hour. Dye-generation was observed to be instantaneous in most instances, however, some dyes required several minutes to form completely.

The following maximum density, D-max, and minimum density, D-min, data were obtained. Status A reflection densities are tabulated for the predominate hue only; R, G, or B. Spectral absorption curves were also obtained to determine the λ-max of each in situ generated dye.

| | Coupler in Receiver | Receiver | Electrophile in Donor | Hue | Formed Dye λ-max nm | Formed Dye Status A D-max/D-min |
|---|---|---|---|---|---|---|
| E-1 | C-19 | R-1 | EL-2 | Magenta | 518 | 1.9/0.07 (G) |
| E-2 | C-18 | R-1 | EL-2 | Yellow Brown | 458 | 0.9/0.07 (B) |
| E-3 | C-1 | R-1 | EL-2 | Blue | 615 | 2.6/0.09 (R) |
| E-4 | C-1 | R-1 | EL-1 | Magenta | 528 | 2.9/0.11 (G) |
| E-5 | C-2 | R-2 | EL-2 | Cyan | 641 | 2.4/0.10 (R) |
| E-6 | C-2 | R-2 | EL-1 | Violet | 538 | 2.3/0.13 (G) |
| E-7 | C-2 | R-2 | EL-3 | Yellow | 460 | 1.0/0.11 (B) |
| E-8 | C-2 | R-1 | EL-2 | Cyan | 641 | 2.7/0.10 (R) |
| E-9 | C-2 | R-1 | EL-1 | Violet | 538 | 2.0/0.12 (G) |

-continued

| | Coupler in Receiver | Receiver | Electrophile in Donor | Hue | Formed Dye λ-max nm | Status A D-max/D-min |
|---|---|---|---|---|---|---|
| E-10 | C-2 | R-1 | EL-3 | Yellow | 460 | 0.9/0.09 (B) |
| E-11 | C-5 | R-1 | EL-1 | Cyan | 607 | 2.3/0.08 (R) |
| E-12 | C-5 | R-1 | EL-2 | Magenta | 496 | 1.8/0.08 (G) |
| E-13 | C-3 | R-2 | EL-2 | Green | 641 | 2.8/0.09 (R) |
| E-14 | C-3 | R-2 | EL-1 | Violet | 533 | 1.9/0.15 (G) |
| E-15 | C-3 | R-2 | EL-3 | Yellow | 465 | 1.5/0.09 (B) |
| E-16 | C-4 | R-2 | EL-2 | Cyan | 625 | 2.3/0.09 (R) |
| E-17 | C-4 | R-2 | EL-1 | Magenta | 525 | 2.4/0.10 (G) |
| E-18 | C-4 | R-2 | EL-3 | Yellow | 465 | 1.7/0.09 (B) |
| E-19 | C-6 | R-1 | EL-2 | Blue | 593 | 2.3/0.07 (R) |
| E-20 | C-6 | R-1 | EL-1 | Red | 507 | 2.4/0.07 (G) |
| E-21 | C-19 | R-1 | EL-2 | Magenta | 530 | 1.9/0.08 (G) |
| E-22 | C-19 | R-1 | EL-1 | Orange | 455 | 2.0/0.09 (B) |
| E-23 | C-20 | R-1 | EL-2 | Red | 501 | 1.5/0.08 (G) |
| E-24 | C-20 | R-1 | EL-1 | Yellow | 440 | 1.5/0.08 (B) |

EXAMPLE 2

This example is similar to Example 1 but illustrates dye-generation imaging with the coupler in the donor and the electrophile in the receiver.

Donor elements were prepared as in Example 1, but in place of the electrophile, the indicated coupler (0.22 g/m$^2$) was coated in a cellulose acetate propionate binder (0.32 g/m$^2$) from ethyl acetate.

Receiving elements were prepared similar to R-1 of Example 1, but in place of the coupler, the electrophile (EL-2) (0.23 g/m$^2$) was coated in the polycarbonate binder (2.9 g/m$^2$) from methylene chloride.

The evaluation procedure was as described in Example 1, and the data below show that good image discrimination is also obtained with this format with change in location of electrophile and coupler as compared to Example 1.

| | Electrophile in Receiver | Coupler in Donor | Hue | Formed Dye λ-max nm | Status A D-min/D-max |
|---|---|---|---|---|---|
| E-31 | EL-2 | C-19 | Magenta | 518 | 1.2/0.18 (G) |
| E-32 | EL-2 | C-30 | Cyan | 612 | 1.6/0.16 (R) |

EXAMPLE 3

This example illustrates the power requirements for thermal imaging with in situ dye generation and for preformed dyes.

Two dyes were evaluated for comparison, E-3 and E-4. A dye image was formed as in Examples 1 and 2 using dye generation and compared to the same dye preformed and coated in the donor for transfer.

Dye E-3

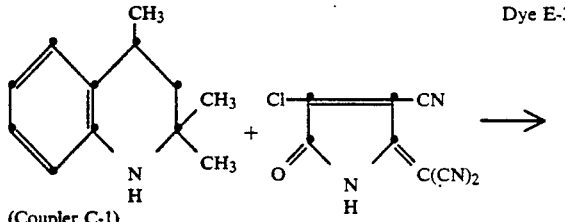

(Coupler C-1) (Electrophile EL-2)

-continued

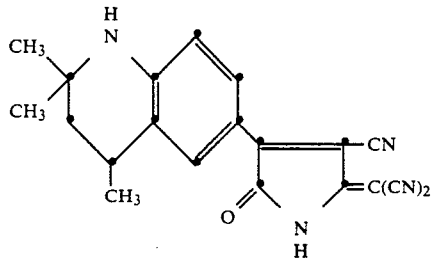

(Formed cyan dye)

Dye E-4

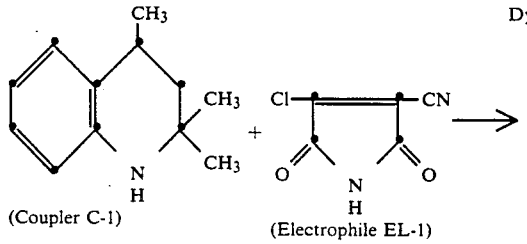

(Coupler C-1) (Electrophile EL-1)

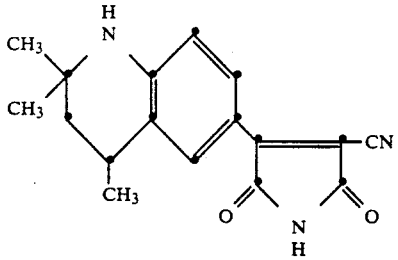

(Formed magenta dye)

Thermal transfer receivers were prepared with the coupler in a polycarbonate binder, R-1, as described in Example 1. Donors containing the electrophile were prepared similar to Example 1 except the electrophile, EL-1, for the magenta dye formation was at 0.055 g/m$^2$ (0.36 mmoles/m$^2$) in cellulose acetate propionate binder (0.14 g/m$^2$) and the electrophile EL-2 for the cyan dye formation was at 0.16 g/m$^2$ (0.77 mmoles/m$^2$) in cellulose acetate propionate binder (0.28 g/m$^2$).

For preformed-dye thermal transfer, donors were prepared as in Example 1 with the above described externally formed magenta and cyan dyes at 0.11 g/m (0.36 mmoles/m$^2$) in cellulose acetate propionate binder (0.27 g/m$^2$) for the magenta and at 0.27 g/m$^2$ (0.77 mmoles/m$^2$) for the cyan. The mmoles of dye were kept constant for the generated and preformed dyes so that comparisons were more meaningful. The receiver used with these donors containing preformed dye was like the R-1 polycarbonate receiver of Example 1 except no coupler was added.

The transfer of the magenta and cyan dyes both preformed and using dye generation was as described below. Graduated density 11 step images were each generated at 15, 19, and 23.5 volts. In this manner plots of dye-density versus a given step number for each voltage were obtained and compared.

The dye-side of a donor element strip approximately 10 cm×13 cm in area was placed in contact with the polymeric receiver layer side of a receiver element of the same area. This assemblage was clamped to a stepper-motor driven 60 mm diameter rubber roller. A TDK Thermal Head L-231 (thermostatted at 26° C.) was pressed with a force of 3.6 kg against the dye-donor element side of the contacted pair pushing it against the rubber roller.

The imaging electronics were activated causing the donor-receiver assemblage to be drawn through the printing head/roller nip at 6.9 mm/sec. Coincidentally the resistive elements in the thermal print head were pulsed for 29 usec/pulse at 128 usec intervals during the 33 msec/dot printing time. A stepped density image was generated by incrementally increasing the number of pulses/dot from 0 to 255. The voltage supplied to the printing head was either 15, 19, or 23.5 volts, resulting in an instantaneous peak power of 1.3 watts/dot and maximum total energy of 9.6 mJoules/dot at the maximum voltage of 23.5. The resulting stepped images were read to Status A green or red reflection density.

| Head Voltage | Step | Magenta Dye Density | | Cyan Dye Density | |
|---|---|---|---|---|---|
| | | Preformed | Generated | Preformed | Generated |
| 15 | 4 | <0.1 | <0.1 | <0.1 | <0.1 |
| | 7 | <0.1 | 0.2 | <0.1 | 0.1 |
| | 10 | <0.1 | 0.6 | <0.1 | 0.3 |
| 19 | 4 | <0.1 | 0.2 | <0.1 | 0.1 |
| | 7 | 0.2 | 0.6 | <0.1 | 0.5 |
| | 10 | 0.3 | 1.2 | 0.1 | 1.1 |
| 23.5 | 4 | <0.1 | 0.5 | <0.1 | 0.2 |
| | 7 | 0.6 | 1.3 | 0.1 | 1.6 |
| | 10 | 0.9 | 1.8 | 0.3 | 2.7 |

From the voltage versus density plots, the voltage required to reach a maximum density of 1.0 was estimated. These values are:

| | Magenta Dye | | Cyan Dye | |
|---|---|---|---|---|
| | Preformed | Generated | Preformed | Generated |
| Voltage to D = 1.0 | 23 v | 19 v | * | 18 v |

*Not feasible-highest density transferred was only 0.3, even at 23.5 volts.

At a given step (given energy) at a specified voltage, higher densities are obtained when the dyes are generated in-situ. The preformed cyan dye in particular was incapable of producing a density greater than 0.3. The preformed magenta dye could produce a density of about 1.0 by transfer. Densities of 2.0 or more were obtained with generation of the same two dyes. Virtually no meaningful desity was transferred with the preformed cyan dye unless a head voltage of 23.5 was used.

EXAMPLE 4

This example illustrates thermal dye-generation imaging with two different electrophiles, EL-1 and EL-2, and a single coupler, C-1, in the donor used with a "non-reagent" receiver. EL-1, EL-2, and C-1 are as illustrated above.

Donors were prepared by coating on a first side of a 6 μm polyethylene terephthalate support: (1) a subbing layer as in Example 1, and (2) a layer of either the magenta electrophile, EL-1 (0.14 g/m$^2$), the cyan electrophile, EL-2 (0.32 g/m$^2$), or the coupler compound, C-1, (1.3 g/m$^2$) in a cellulose acetate propionate binder (2.5% acetyl, 45% propionyl) (at 0.14, 0.28, or 0.57 g/m$^2$, respectively) from ethyl acetate. On the reverse side of the supports, subbing and slipping layers were coated as in Example 1. The receiver used with these donors was like the R-1 polycarbonate receiver of Example 1 except no coupler was added.

The dye-side of an electrophile donor element approximately 3 cm×15 cm in area was placed in contact with a receiver element of the same area. This assemblage was clamped to a stepper-motor driven 60 mm diameter rubber roller. A TDK Thermal Head L-231 (thermostatted at 26° C.) was pressed with a force of 3.6 kg against the dye-donor element side of the contacted pair pushing it against the rubber roller.

The imaging electronics were activated causing the donor-receiver assemblage to be drawn through the printing head/roller nip at 6.9 mm/sec. Coincidentally the resistive elements in the thermal print head were pulsed for 29 usec/pulse at 128 usec intervals during the 33 msec/dot printing time. A stepped density image was generated by incrementally increasing the number of pulses/dot from 0 to 255. The voltage supplied to the printing head was 18 volts, resulting in an instantaneous peak power of 1.3 watts/dot and maximum total energy of 7.8 mJoules/dot.

After either the magenta or cyan electrophile-donor was printed, the complete area of the coupler-donor was overprinted non-imagewise on the receiver at 18. volts. As soon as this overprinting was done, magenta and cyan dye were observed to form.

For comparison, the magenta and cyan electrophiles were transferred under the same conditions to a receiver already containing the coupler compound (at 0.23 g/m$^2$) coated in the polycarbonate layer as in Example 1.

Each receiver was separated from the donor and the Status A green (G) and red (R) reflection densities of each single color transferred image consisting of a series of eleven graduated density steps one cm square were read within one hour.

| Step (Pulses/Dot) | | Status A Density | | | |
|---|---|---|---|---|---|
| | | Coupler Coated in Receiver | | Coupler Transferred from Donor | |
| | | Magenta (G) | Cyan (R) | Magenta (G) | Cyan (R) |
| 0 (Dmin) | 0 | 0.10 | 0.06 | 0.12 | 0.07 |
| 4 | 92 | 0.12 | 0.07 | 0.13 | 0.09 |
| 7 | 161 | 0.63 | 0.29 | 0.59 | 0.37 |

-continued

| | | Status A Density | | | |
|---|---|---|---|---|---|
| | | Coupler Coated in Receiver | | Coupler Transferred from Donor | |
| Step (Pulses/Dot) | | Magenta (G) | Cyan (R) | Magenta (G) | Cyan (R) |
| 11 (Dmax) | 255 | 1.37 | 0.87 | 1.64 | 1.35 |

The above data shows that high densities can be obtained by delivery of both the coupler compound and the electrophile from a donor element.

The invention has been described in detail with particular reference to preferred embodiments thereof, but it will be understood that variations and modifications can be effected within the spirit and scope of the invention.

What is claimed is:

1. A dye image recording element comprising a support bearing an electrophile capable of reacting with a coupler compound to form an arylidene dye, said electrophile having the following structure:

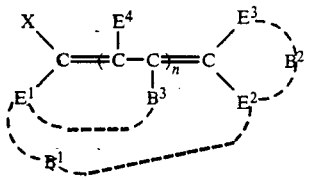

wherein

X is halogen, substituted or unsubstituted alkylsulfonyloxy, substituted or unsubstituted arylsulfonyloxy, or substituted or unsubstituted acyloxy;

$E^1$, $E^2$, $E^3$, and $E^4$ are each independently hydrogen, substituted or unsubstituted alkyl or alkenyl having up to about six carbon atoms, substituted or unsubstituted aryl having up to about ten carbon atoms, halogen, cyano, benzoxazolyl, nitro, $—CO_2R$, —COR, $—CONH_2$, —CONHR, —CONRR, or $—SO_2R$, wherein each R is independently substituted or unsubstituted alkyl or alkenyl having up to about six carbon atoms, or substituted or unsubstituted aryl having up to about ten carbon atoms, with the proviso that at least two of the E groups are other than hydrogen, alkyl, alkenyl, aryl or halogen;

$B^1$ and $B^2$ represent the atoms necessary to complete optional five- or six-member rings formed with carbonyl moieties of $E^1$, $E^2$, or $E^3$;

$B^3$ represents hydrogen or the atoms necessary to complete an optional five- or six-member ring with a carbonyl moiety of $E^1$;

and n is zero or one.

2. The element of claim 1, wherein n is zero and $E^1$ and $E^2$ together form $—C(O)NR^1C(O)—$ where $R^1$ is hydrogen, or substituted or unsubstituted alkyl or alkenyl having up to about six carbon atoms or aryl having up to about ten carbon atoms.

3. The element of claim 2, wherein the electrophile is:

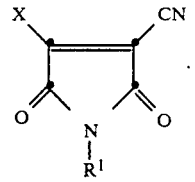

4. The element of claim 1, wherein the electrophile is:

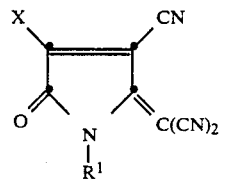

where $R^1$ is hydrogen, or substituted or unsubstituted alkyl or alkenyl having up to about six carbon atoms or aryl having up to about ten carbon atoms.

5. The element of claim 1, wherein the electrophile is:

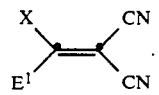

6. The element of claim 1, wherein said support bears sequential repeating areas of plural distinct electrophiles, each electrophile being capable of reacting with a coupler compound to form dyes of different hues.

7. The element of claim 1, wherein said support bears said electrophile in a first area, and wherein said element further comprises a second, separate adjacent area of said support bearing said coupler compound.

8. The element of claim 7, wherein said support bears sequential repeating areas of plural distinct electrophiles, each electrophile being capable of reacting with said coupler compound to form dyes of different hues.

9. The element of claim 7, wherein said support bears sequential repeating areas of plural distinct coupler compounds, each coupler compound being capable of reacting with said electrophile to form dyes of different hues.

10. The element of claim 7, wherein the coupler compound is an aromatic amine, an aromatic hydroxyl compound, a compound comprising a five-member unsaturated hetero-ring having at least one N, O, or S atom, or a compound of the formula $G^1—CH_2—G^2$ wherein $G^1$ and $G^2$ are each independently:

cyano, substituted or unsubstituted aryl, five- or six-member N, O, or S containing unsaturated hetero-ring, $—CO_2R^2$, $—COR^2$, or $—CONR^2R^3$, where $R^2$ and $R^3$ are each independently hydrogen or substituted or unsubstituted alkyl, alkenyl, or aryl having up to about ten carbon atoms, and wherein $G^1$ and $G^2$ may be optionally joined to form a carbocyclic ring.

11. A dye image recording assemblage comprising:

(a) a first element comprising a first support bearing on one surface of the first support a coupler compound capable of reacting with an electrophile to form an arylidene dye, and (b) a second element comprising a second support bearing on one surface of the second support said electrophile, said electrophile having the following structure:

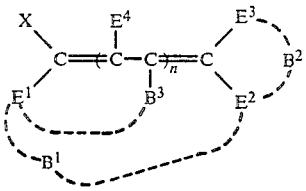

wherein

X is halogen, substituted or unsubstituted alkylsulfonyloxy, substituted or unsubstituted arylsulfonyloxy, or substituted or unsubstituted acyloxy;

$E^1$, $E^2$, $E^3$, and $E^4$, are each independently hydrogen, substituted or unsubstituted alkyl or alkenyl having up to about six carbon atoms, substituted or unsubstituted aryl having up to about ten carbon atoms, halogen, cyano, benzoxazolyl, nitro, $—CO_2R$, —COR, $—CONH_2$, —CONHR, —CONRR, or $—SO_2R$, wherein each R is independently substituted or unsubstituted alkyl or alkenyl having up to about six carbon atoms, or substituted or unsubstituted aryl having up to about ten carbon atoms, with the proviso that at least two of the E groups are other than hydrogen, alkyl, alkenyl, aryl or halogen;

$B^1$ and $B^2$ represent the atoms necessary to complete optional five- or six-member rings formed with carbonyl moieties of $E^1$, $E^2$ or $E^3$;

$B^3$ represents hydrogen or the atoms necessary to complete an optional five- or six-member ring with a carbonyl moiety of $E^1$;

and n is zero or one, wherein said first element and said second element are in superposed relationship with each other so that the surface of the first support bearing the coupler compound faces the surface of the second support bearing the electrophile.

12. The assemblage of claim 11, wherein the coupler compound is an aromatic amine, an aromatic hydroxyl compound, a compound comprising a five-member unsaturated hetero-ring having at least one N, O, or S atom, or a compound of the formula $G^1—CH_2—G^2$ wherein $G^1$ and $G^2$ are each independently:

cyano, substituted or unsubstituted aryl, five- or six-member N, O, or S containing unsaturated hetero-ring, $—CO_2R^2$, $—COR^2$, or $—CONR^2R^3$, where $R^2$ and $R^3$ are each independently hydrogen or substituted or unsubstituted alkyl, alkenyl, or aryl having up to about ten carbon atoms, and wherein $G^1$ and $G^2$ may be optionally joined to form a carbocyclic ring.

13. The assemblage of claim 12, wherein the coupler is an aromatic amine and the electrophile is:

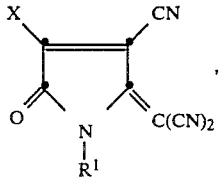

-continued

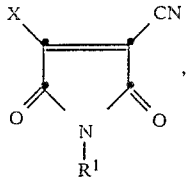

, or

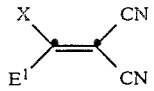

where $R^1$ is hydrogen, or substituted or unsubstituted alkyl or alkenyl having up to about six carbon atoms or aryl having up to about ten carbon atoms.

14. A process for forming a dye image comprising imagewise transferring an electrophile from a donor element comprising a support bearing said electrophile to a receiver element comprising a support bearing a coupler compound capable of reacting with said electrophile to form an arylidene dye, and reacting said electrophile with said coupler compound to form said dye image, wherein said electrophile has the following structure:

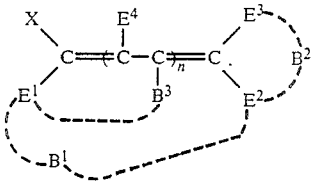

wherein

X is halogen, substituted or unsubstituted alkylsulfonyloxy, substituted or unsubstituted arylsulfonyloxy, or substituted or unsubstituted acyloxy;

$E^1$, $E^2$, $E^3$, and $E^4$are each independently hydrogen, substituted or unsubstituted alkyl or alkenyl having up to about six carbon atoms, substituted or unsubstituted aryl having up to about ten carbon atoms, halogen, cyano, benzoxazolyl, nitro, $—CO_2R$, —COR, $—CONH_2$, —CONHR, —CONRR, or $—SO_2R$, wherein each R is independently substituted or unsubstituted alkyl or alkenyl having up to about six carbon atoms, or substituted or unsubstituted aryl having up to about ten carbon atoms, with the proviso that at least two of the E groups are other than hydrogen, alkyl, alkenyl, aryl or halogen;

$B^1$ and $B^2$ represent the atoms necessary to complete optional five- or six-member rings formed with carbonyl moieties of $E^1$, $E^2$ or $E^3$;

$B^3$ represents hydrogen or the atoms necessary to complete an optional five- or six-member ring with a carbonyl moiety of $E^1$;

and n is zero or one.

15. The process of claim 14, wherein the coupler compound is an aromatic amine, an aromatic hydroxyl compound, a compound comprising a five-member unsaturated hetero-ring having at least one N, O, or S atom, or a compound of the formula $G^1—CH_2—G^2$ wherein $G^1$ and $G^2$ are each independently:

cyano, substituted or unsubstituted aryl, five- or six-member N, O, or S containing unsaturated hetero-ring, $—CO_2R^2$, $—COR^2$, or $—CONR^2R^3$, where $R^2$ and $R^3$ are each independently hydrogen or substituted or unsubstituted alkyl, alkenyl, or aryl having up to about ten carbon atoms, and wherein $G^1$ and $G^2$ may be optionally joined to form a carbocyclic ring.

16. The process of claim 15, wherein the coupler is an aromatic amine and the electrophile is:

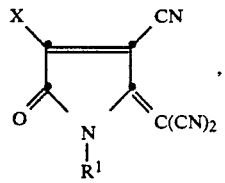

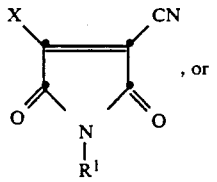

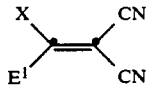

where $R^1$ is hydrogen, or substituted or unsubstituted alkyl or alkenyl having up to about six carbon atoms or aryl having up to about ten carbon atoms.

17. A process for forming a dye image comprising imagewise transferring a coupler compound from a donor element comprising a support bearing said coupler compound to a receiver element comprising a support bearing an electrophile capable of reacting with said coupler compound to form an arylidene dye, and reacting said electrophile with said coupler compound to form said dye image, wherein said electrophile has the following structure:

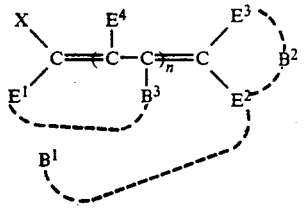

wherein

X is halogen, substituted or unsubstituted alkylsulfonyloxy, substituted or unsubstituted arylsulfonyloxy, or substituted or unsubstituted acyloxy;

$E^1$, $E^2$, $E^3$, and $E^4$ are each independently hydrogen, substituted or unsubstituted alkyl or alkenyl having up to about six carbon atoms, substituted or unsubstituted aryl having up to about ten carbon atoms, halogen, cyano, benzoxazolyl, nitro, $—CO_2R$, —COR, $—CONH_2$, —CONHR, —CONRR, or $—SO_2R$, wherein each R is independently substituted or unsubstituted alkyl or alkenyl having up to about six carbon atoms, or substituted or unsubstituted aryl having up to about ten carbon atoms, with the proviso that at least two of the E groups are other than hydrogen, alkyl, alkenyl, aryl or halogen;

$B^1$ and $B^2$ represent the atoms necessary to complete optional five- or six-member rings formed with carbonyl moieties of $E^1$, $E^2$ or $E^3$;

$B^3$ represents hydrogen or the atoms necessary to complete an optional five- or six-member ring with a carbonyl moiety of $E^1$;

and n is zero or one.

18. The process of claim 17, wherein the coupler compound is an aromatic amine, an aromatic hydroxyl compound, a compound comprising a five-member unsaturated hetero-ring having at least one N, O, or S atom, or a compound of the formula $G^1—CH_2—G^2$ wherein $G^1$ and $G^2$ are each independently:

cyano, substituted or unsubstituted aryl, five- or six-member N, O, or S containing unsaturated hetero-ring, $—CO_2R^2$, $—COR^2$, or $—CONR^2R^3$, where $R^2$ and $R^3$ are each independently hydrogen or substituted or unsubstituted alkyl, alkenyl, or aryl having up to about ten carbon atoms, and wherein $G^1$ and $G^2$ may be optionally joined to form a carbocyclic ring.

19. The process of claim 18, wherein the coupler is an aromatic amine and the electrophile is:

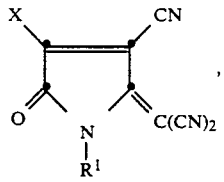

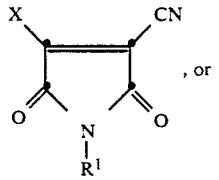

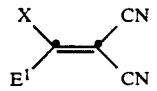

where $R^1$ is hydrogen, or substituted or unsubstituted alkyl or alkenyl having up to about six carbon atoms or aryl having up to about ten carbon atoms.

20. A process for forming a dye image on a receiving element comprising:

(a) transferring an electrophile from a donor element comprising a support bearing said electrophile to said receiving element;

(b) transferring a coupler compound capable of reacting with said electrophile to form an arylidene dye from a donor element comprising a support bearing said coupler compound to said receiving element; and (c) reacting said electrophile with said coupler compound to form said dye image;

wherein at least one of said electrophile and said coupler compound is transferred imagewise, and wherein said electrophile has the following structure:

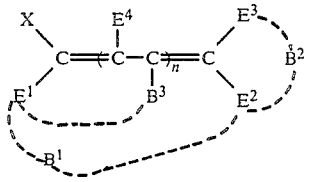

wherein

X is halogen, substituted or unsubstituted alkylsulfonyloxy, substituted or unsubstituted arylsulfonyloxy, or substituted or unsubstituted acyloxy;

$E^1$, $E^2$, $E^3$, and $E^4$ are each independently hydrogen, substituted or unsubstituted alkyl or alkenyl having up to about six carbon atoms, substituted or unsubstituted aryl having up to about ten carbon atoms, halogen, cyano, benzoxazolyl, nitro, $—CO_2R$, —COR, $—CONH_2$, —CONHR, —CONRR, or $—SO_2R$, wherein each R is independently substituted or unsubstituted alkyl or alkenyl having up to about six carbon atoms, or substituted or unsubstituted aryl having up to about ten carbon atoms, with the proviso that at least two of the E groups are other than hydrogen, alkyl, alkenyl, aryl or halogen;

$B^1$ and $B^2$ represent the atoms necessary to complete optional five- or six-member rings formed with carbonyl moieties of $E^1$, $E^2$ or $E^3$;

$B^3$ represents hydrogen or the atoms necessary to complete an optional five- or six-member ring with a carbonyl moiety of $E^1$;

and n is zero or one.

21. The process of claim 20, wherein the coupler compound is an aromatic amine, an aromatic hydroxyl compound, a compound comprising a five-member unsaturated hetero-ring having at least one N, O, or S atom, or a compound of the formula $G^1—CH_2—G^2$ wherein $G^1$ and $G^2$ are each independently:

cyano, substituted or unsubstituted aryl, five- or six-member N, O, or S containing unsaturated hetero-ring, $—CO_2R^2$, $—COR^2$, or $—CONR^2R^3$, where $R^2$ and $R^3$ are each independently hydrogen or substituted or unsubstituted alkyl, alkenyl, or aryl having up to about ten carbon atoms, and wherein $G^1$ and $G^2$ may be optionally joined to form a carbocyclic ring.

22. The process of claim 21, wherein the coupler is an aromatic amine and the electrophile is:

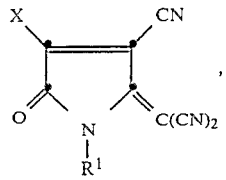

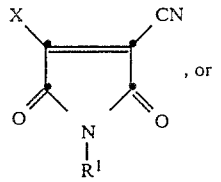

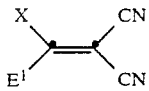

where $R^1$ is hydrogen, or substituted or unsubstituted alkyl or alkenyl having up to about six carbon atoms or aryl having up to about ten carbon atoms.

23. The process of claim 20, wherein step (a) further comprises sequentially individually imagewise transferring plural distinct electrophiles, each electrophile being capable of reacting with said coupler compound to form dyes of different hues.

24. The process of claim 23, wherein the coupler compound is transferred imagewise corresponding to the total density of the plural electrophiles individually transferred.

25. The process of claim 23, wherein the coupler compound is transferred uniformly.

26. The process of claim 20, wherein step (b) further comprises sequentially individually imagewise transferring plural distinct coupler compounds, each coupler compound being capable of reacting with said electrophile to form dyes of different hues.

27. The process of claim 26, wherein the electrophile is transferred imagewise corresponding to the total density of the plural coupler compounds individually transferred.

28. The process of claim 26, wherein the electrophile is transferred uniformly.

* * * * *